US008702128B2

(12) United States Patent
Rowe et al.

(10) Patent No.: US 8,702,128 B2
(45) **Date of Patent: *Apr. 22, 2014**

(54) NOTEBOOK COVER WITH EXTENDING HOLE-PUNCHED TABS FOR FACILITATING ATTACHMENT TO RINGED BINDER

(75) Inventors: Michael D. Rowe, Kettering, OH (US); Edward P. Busam, Mason, OH (US)

(73) Assignee: ACCO Brands Corporation, Lake Zurich, IL (US)

( * ) Notice: Subject to any disclaimer, the term of this patent is extended or adjusted under 35 U.S.C. 154(b) by 115 days.

This patent is subject to a terminal disclaimer.

(21) Appl. No.: 12/264,630

(22) Filed: Nov. 4, 2008

(65) Prior Publication Data

US 2009/0236843 A1 Sep. 24, 2009

Related U.S. Application Data

(60) Provisional application No. 61/038,868, filed on Mar. 24, 2008, provisional application No. 61/086,550, filed on Aug. 6, 2008.

(51) Int. Cl.
*B42D 3/18* (2006.01)
*B42F 21/02* (2006.01)

(52) U.S. Cl.
USPC ..... 281/29; 283/36; 281/21.1; 281/51

(58) Field of Classification Search
USPC ..... 281/7–12, 14, 15.1, 21.1, 23, 26, 27, 281/29, 32, 43–45, 47, 48, 50, 51; 402/4, 402/79, 80 R; 40/359, 401, 402, 404; 283/36–40, 42, 43
See application file for complete search history.

(56) References Cited

U.S. PATENT DOCUMENTS

| | | | |
|---|---|---|---|
| 1,048,577 | A | 12/1912 | Pardoe, Jr. |
| 1,552,103 | A | 9/1925 | Wood |
| 1,843,771 | A | 2/1932 | Kline |
| 1,876,181 | A | 9/1932 | Tussing |
| 2,001,462 | A | 5/1935 | Hiller |

(Continued)

FOREIGN PATENT DOCUMENTS

| | | |
|---|---|---|
| EP | 1346848 | 9/2003 |
| JP | 07-149090 | 6/1995 |

(Continued)

OTHER PUBLICATIONS

Office Action, U.S. Appl. No. 12/392,183 [Apr. 16, 2009].

(Continued)

*Primary Examiner* — Shelly Self
*Assistant Examiner* — Pradeep C Battula
(74) *Attorney, Agent, or Firm* — Thompson Hine L.L.P.

(57) ABSTRACT

A bound system including a plurality of pages and a cover and/or divider including a bound outer edge and a plurality of free outer edges. The cover and/or divider may be bound to the plurality of pages along the bound edge. The cover and/or divider may include one or more discreet tabs extending generally outwardly relative to one of the edges. Each tab may be integrally formed from a single piece of material with the rest of the cover and/or divider. Each tab further may have an opening formed therethrough and is configured to receive at least part of a binding device therethrough to thereby couple the cover and/or divider to the binding device.

24 Claims, 12 Drawing Sheets

(56) References Cited

U.S. PATENT DOCUMENTS

| | | | | | |
|---|---|---|---|---|---|
| 2,300,623 | A | * | 11/1942 | Hornung | 283/38 |
| 2,599,768 | A | | 1/1946 | Losch, Jr. | |
| 3,014,580 | A | | 12/1961 | Brody et al. | |
| 3,561,147 | A | * | 2/1971 | Valencia | 283/38 |
| 3,700,264 | A | * | 10/1972 | Friedman | 283/38 |
| 3,913,740 | A | * | 10/1975 | Bisberg | 281/3.1 |
| 4,314,635 | A | * | 2/1982 | Fraser et al. | 281/35 |
| 4,395,059 | A | | 7/1983 | Russell, III | |
| 4,400,107 | A | | 8/1983 | Pitts | |
| 4,498,828 | A | * | 2/1985 | Ackerman | 281/29 |
| 4,595,309 | A | | 6/1986 | Chinchar | |
| 4,758,022 | A | | 7/1988 | Podosek et al. | |
| 4,863,194 | A | | 9/1989 | Friedman | |
| 4,948,173 | A | | 8/1990 | Hincks | |
| 4,961,666 | A | | 10/1990 | Pitts et al. | |
| 5,125,561 | A | | 6/1992 | Idstein | |
| 5,127,674 | A | | 7/1992 | Lamphere et al. | |
| 5,186,565 | A | | 2/1993 | Jack | |
| D337,784 | S | | 7/1993 | Wyant | |
| 5,240,340 | A | | 8/1993 | Lynch et al. | |
| 5,275,439 | A | | 1/1994 | Hawes | |
| 5,350,061 | A | | 9/1994 | Gunn | |
| 5,407,231 | A | | 4/1995 | Schwartz | |
| 5,540,513 | A | | 7/1996 | Wyant | |
| 5,599,128 | A | | 2/1997 | Steiner | |
| 5,639,124 | A | * | 6/1997 | Jung | 283/36 |
| 5,683,194 | A | | 11/1997 | Emmel et al. | |
| 5,785,446 | A | | 7/1998 | Dlugos | |
| 5,836,711 | A | | 11/1998 | Stewart | |
| 5,876,145 | A | | 3/1999 | Datum | |
| 5,954,445 | A | | 9/1999 | Deutschmann et al. | |
| 6,017,062 | A | | 1/2000 | White | |
| 6,209,778 | B1 | | 4/2001 | Henrikson et al. | |
| D451,273 | S | | 12/2001 | Moor et al. | |
| 6,390,713 | B1 | | 5/2002 | Moor et al. | |
| 6,409,409 | B2 | | 6/2002 | Bauman et al. | |
| D462,715 | S | | 9/2002 | Moor et al. | |
| 6,505,859 | B1 | | 1/2003 | Josephson | |
| 6,626,601 | B1 | | 9/2003 | Moor et al. | |
| 6,736,428 | B1 | | 5/2004 | Insalaco | |
| 6,758,498 | B2 | | 7/2004 | Sapienza et al. | |
| 7,628,426 | B1 | | 12/2009 | Rowe | |
| 2001/0022916 | A1 | | 9/2001 | Moor et al. | |
| 2002/0101073 | A1 | * | 8/2002 | Lang | 283/56 |
| 2004/0040193 | A1 | | 3/2004 | Slattery et al. | |
| 2004/0247375 | A1 | | 12/2004 | Wehmeyer et al. | |
| 2006/0059755 | A1 | | 3/2006 | Valade et al. | |
| 2006/0076771 | A1 | | 4/2006 | Schafer | |
| 2006/0138765 | A1 | * | 6/2006 | Girard | 281/21.1 |
| 2006/0285914 | A1 | | 12/2006 | Bassford et al. | |
| 2007/0029777 | A1 | | 2/2007 | Williams | |
| 2008/0016743 | A1 | | 1/2008 | Graves | |
| 2008/0085146 | A1 | | 4/2008 | Botkin | |
| 2008/0157516 | A1 | | 7/2008 | Gokkel | |
| 2008/0308621 | A1 | | 12/2008 | Spink | |

FOREIGN PATENT DOCUMENTS

| | | |
|---|---|---|
| JP | 09-071065 | 3/1997 |
| JP | 9295488 | 11/1997 |
| JP | 10297146 | 11/1998 |
| JP | 11-078341 | 3/1999 |
| JP | 2001-002152 | 1/2001 |
| JP | 2008-023901 | 2/2008 |
| WO | 96/22888 | 8/1996 |

OTHER PUBLICATIONS

Office Action, U.S. Appl. No. 12/392,183 [Apr. 24, 2009].
Office Action, U.S. Appl. No. 12/392,183 [Oct. 21, 2009].
Office Action, U.S. Appl. No. 12/420,444 [May 6, 2009].
Office Action, U.S. Appl. No. 12/420,444 [Jul. 15, 2009].
Office Action, U.S. Appl. No. 12/420,444 [Sep. 11, 2009].
Notice of Allowance, U.S. Appl. No. 12/420,444 [Oct. 20, 2009].
"Blank Index Tab Dividers," by Permaseal Corporation, *Managing Office Technology*, 39, 9; ABI/INFORM Global, p. 85 (Sep. 1994).
Web page, Google http://www.qoogle.com, featuring "Index Tabs Your Way, Fast" by SimPro, Inc., www.simpro-products.com (Sep. 2008).
Denton, S., This filing system is as easy as ABC; [1, 2, 6, 7 Edition], *The San Diego Union—Tribune*, San Diego, California, p. F8 (Jul. 10, 2002).
Scott, P., Back-to-school gear: cool, smart and maybe too much fun; [1, 2, 3, 4, 5 Edition], *The San Diego Union—Tribune*, San Diego, California, p. E4 (Aug. 28, 1993).
"Put It on My Tab," *Printing Expressions*; 45, 10; ABI/INFORM Global, p. 46 (Mar. 2003).
Eichorn, R.N., "No Burst or Cut, Continuous Forms," *IBM Technical Disclosure Bulletin*, pp. 10-11.
"Technology Showcase," Managing Office Technology, vol. 42, Issue 12, p. 32 (Dec. 1997).
"Bound material tabs," *Managing Office Technology*, vol. 42, Issue 11, p. 14 (Nov. 1997).
"Tag and Label Move Through Quality Control Process," *Quality Progress*, vol. 37, Issue 7, p. 97 (Jul. 2004).
Web page, www.bizrate.com featuring "Miscellaneous Binders & Accessories" (Sep. 2008).
Cross, R.G., "Tear Off Bar for Perforated 2206 Continuous Forms," *IBM Technical Disclosure Bulletin*, pp. 2205-2206 (Nov. 1978).
Redpath, S.D., "System Notebook Visual Rendition," *IBM Technical Disclosure Bulletin*, pp. 225-226 (Jul. 1992).
Web page, http://www.carstens.com, featuring "9-Tab Blank All White Poly Chart Divider Set for Side-Opening Ringbinder Chartholders" (Oct. 2008).
Web page, http://www.alibaba.com, featuring "Tab Divider, Index Tab, Transparent Index Tab, PP Tab Divider" (Oct. 2008).
Web page, http://www.nextag.com, featuring "Avery Nos. 1-5 Tab Executive Dividers, Multi Color" (Oct. 2008).
Web page, http://www.sears.com, featuring "ACCO View Tab Transp. Dividers" (Oct. 2008).
Web page, http://www.shoplet.com, featuring "Smead Mortgage File Folders w/Dividers" (Oct. 2008).

* cited by examiner

NOTEBOOK COVER WITH EXTENDING HOLE-PUNCHED TABS FOR FACILITATING ATTACHMENT TO RINGED BINDER

The present application is related to, and claims priority to, U.S. Provisional Application No. 61/038,868, filed Mar. 24, 2008, and U.S. Provisional Application No. 61/086,550, filed Aug. 6, 2008, the entire contents of both of which are hereby incorporated by reference.

BACKGROUND

The present application is directed to the attachment of a bound component to a ring-type binder and, more particularly, to a bound notebook with at least one cover thereof incorporating tabs for facilitating attachment to a ring-type binder. In greater detail, the present application discloses a means for attaching a notebook or folder to a ring-type binder through the use of tabs/tab extensions.

Some notebook products may have holes drilled or punched through the entire contents thereof to allow placement of sheets removed therefrom onto a multi-ring (e.g., 2 or 3 ring) binder fixture. Likewise, the entire notebook, folder, or other bound component, with the unremoved sheets, can be attached on the binder rings, via those same holes. However, the bound component, when attached in this manner, is difficult to open and to use properly without removing it from the binder rings. This problem arises because the pivot locations of the binding mechanism of the bound component and the binder spine/binder rings of the binder fixture essentially coincide, thereby interfering with one another. In particular, such interference typically manifests itself in the fact that the attached bound component cannot be opened so as to lay flat during use, while still linked with the multi-ring binder, due to interference with the binder rings. Also, it is not possible to neatly remove perforated sheets from many currently constructed bound components without first removing the bound component from the binder.

Accordingly, there is a need for a cover and related bound component construction that will permit attachment thereof to a multi-ring binder that will facilitate the easy opening and use thereof while still mounted in the binder. Additionally, there is a need for a notebook construction that will allow easy removal of perforated notebook pages without removing the notebook from the ringed binder.

Further, notebook/divider products are available that provide tabbing to permit identification of, for example, materials stored in a notebook or a folder or topical sections of a notebook. However, there is not a system in place both that permits selective display of any combination of a group of available tabs and that allows any such tab to be stably retained in a folded-out, display position. Accordingly, the need exists for an improved tabbing system.

SUMMARY

In one embodiment, the invention is a bound system including a plurality of pages and a cover/divider including a bound outer edge and a plurality of free outer edges. The cover/divider is bound to the plurality of pages along the bound edge. The cover/divider includes one or more discreet tabs extending generally outwardly relative to one of the free edges. Each tab is integrally formed from a single piece of material with the rest of the cover/divider. Each tab further has an opening formed therethrough and is configured to receive at least part of a binding device therethrough to thereby couple the cover/divider to the binding device.

Other aspects of the disclosed cover construction and the bound component employing such will become apparent from the following description and the accompanying drawings.

DETAILED DESCRIPTION

Figure 1:
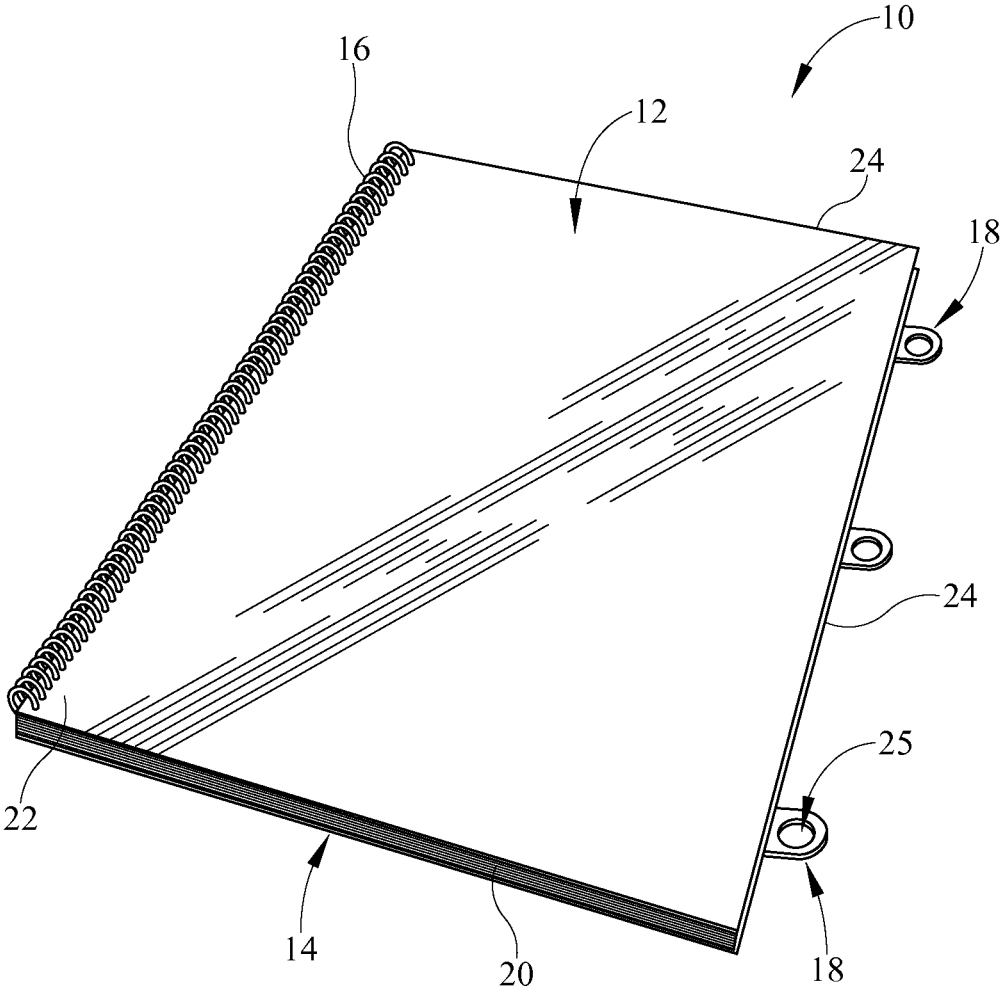
FIG. 1 is a top isometric view of one aspect of the disclosed cover construction, employed with a bound component, shown in this instance in a folded condition and unattached to a multi-ring binder.
Figure 2:
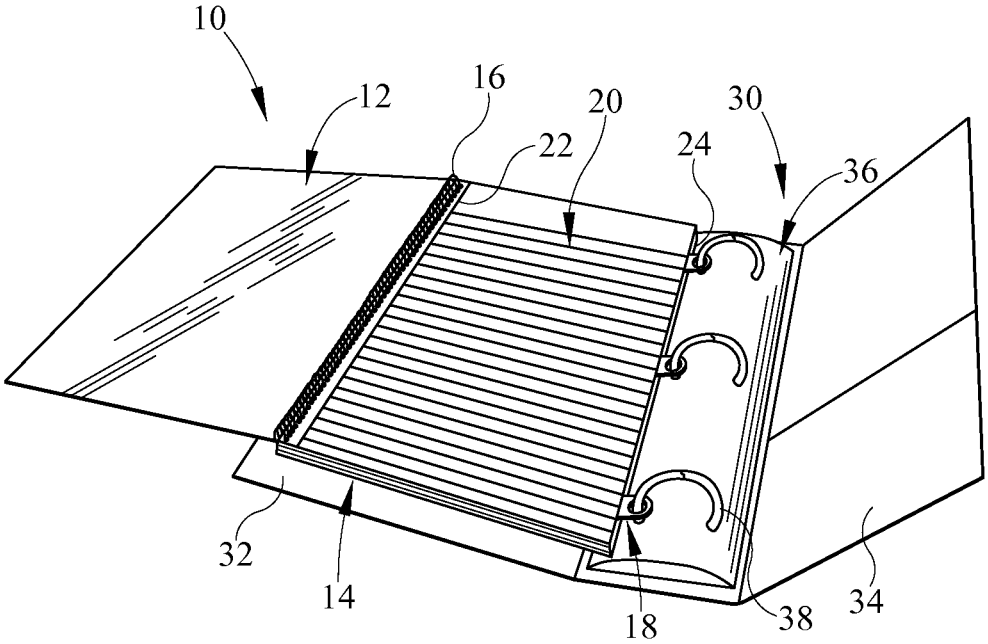
FIG. 2 is a top isometric view of another aspect of the disclosed cover construction, employed with a bound component depicted as a notebook, shown in an open condition and attached to a multi-ring binder, by using the binder attachment tabs on a first one of the two covers.

Referring to FIG. 1, a bound component, generally disclosed as 10, may include a first cover/divider 12, a second or supplemental cover/divider 14, a binding mechanism 16, and at least one binder attachment tab/projection 18 extending from one or more of the covers 12, 14. The bound component 10 may be a polygonal (e.g., 3 or 4 sided) component that bears at least one pivot point and/or hinge line and that has at least one cover or divider 12, 14. By such a pivot/hinge, a user may open the bound component 10 and thereby view, retrieve, or otherwise employ the inner contents of the bound component 10 while the bound component 10 remains linked to a binding device, such as a multi-ring binder 30 (FIG. 2). By way of example, the bound component 10 may be a notebook, planner, journal, diary, notepad or the like, but it could further be a folder, a covered calculator, a foldable case (e.g., for holding pens/pencils), etc.

Figure 3:
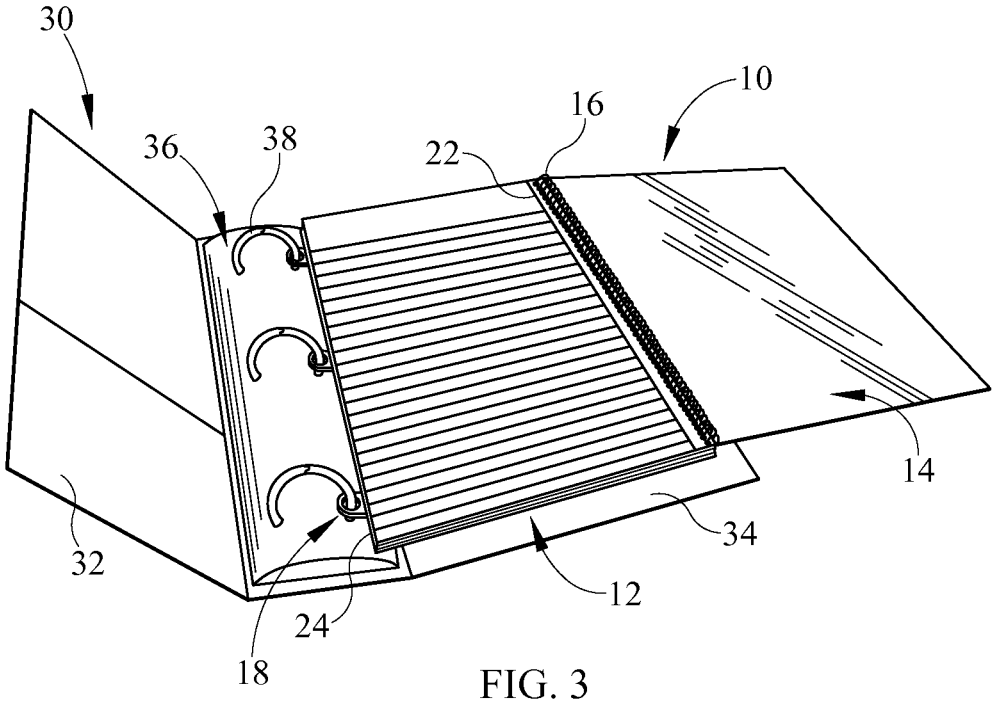
FIG. 3 is a top isometric view of yet another aspect of the disclosed cover construction, employed with a bound component such as a notebook, shown in an open condition and attached to a multi-ring binder, by using binder attachment tabs on a second one of the two covers.

Referring to FIGS. 2 and 3, the bound component 10 may be attached to the multi-ring binder 30 by the binder attachment tabs 18 associated with the first cover 12 and/or second cover 14. As shown in FIGS. 2 and 3, the bound component 10 may further include a plurality of papers, sheets, or pages 20. The multi-ring binder 30, in turn, may include a first binder cover 32, a second binder cover 34, a binder spine 36, and a plurality of binder rings 38. The binder rings 38 could be the traditional circular clip rings or, in the alternative, binder straps, hinged clips, or any other form of a releasable binder mechanism.

The first cover 12 and the second cover 14 together may serve as front and back covers for the bound component 10, with either cover 12, 14 being able to serve as a front or back cover, depending on the desired application. Additionally, it is to be understood that just a first cover 12 may be employed in certain circumstances and that the first and/or second cover 12, 14 could be used as a divider positioned in the middle of the thickness of the bound component 10, and not necessarily as a front or back cover, per se. The first and second covers 12, 14 may be made of paper board (e.g., coated or uncoated natural Kraft board), plastic (e.g., polypropylene), leather, metal, felt, a composite, or another suitable material such that the covers 12, 14 are thicker and/or stiffer then the pages 20 to protect the pages 20 and allow the covers 12, 14 to be easily visually or tactilely located.

Each cover 12, 14 may be shaped and sized to generally cover an outer one of (i.e. the top or bottom, as appropriate) of the pages 20 when the cover 12, 14 is in a closed position to thereby protect the pages 20 (see FIG. 1 wherein both the covers 12, 14 are in their closed positions). Additionally, as per FIGS. 1-3, the binding mechanism 16 may be used to link/bind the first cover 12, the second cover 14, and the pages 20. In the illustrated embodiment the covers 12, 14 are made of separate pieces of material and are indirectly coupled together by the binding mechanism 16, and thus are spaced apart from and not directly coupled together. The binding mechanism 16 may, for example, be a more or less permanent fixture (i.e. such that the pages 20 are torn when removed) such as a wire (e.g., twin or spiral) coil, sewn binding, book-style binding, plastic clip, or the like or a less permanent fixture like a metal, wire, or plastic clip (e.g., a report binder), so long as the binding mechanism 16 is configured for acting as a pivot/hinge location for the covers 12, 14 and pages 20. It is also to be recognized that the binding mechanism 16 could be covered or uncovered (e.g., a covered spiral).

Accordingly, the bound component 10, and each first and second cover 12, 14, and the pages 20 may include a bound cover edge 22, which is bound by the binding mechanism 16 (or along which the bound component 10 is bound), and at least one unbound or free cover edge 24, wherein each edge 22, 24 may extend at an angle relative to the other adjacent edges (ninety degrees in the illustrated embodiment). In particular, a bound cover edge 22 may be directly fastened or otherwise linked to the binding mechanism 16, in contradistinction to a given free cover edge 24. Thus, for example, when the bound component 10 is a notebook, there may be one bound cover edge 22 and three free cover edges 24. In the illustrated embodiment, the binding mechanism 16 extends generally an entire length of the bound cover edge 22.

The binder attachment tabs 18 may be associated with any given free cover edge 24 of either one of the first and second covers 12, 14. Such binder attachment tabs 18 may, in particular, facilitate the linkage of a given first or second cover 12, 14 with a respective binder ring 38. In one case the binder attachment tabs 18 are positioned on an opposite side of the cover 12, 14 relative to the binding mechanism 16/bound cover edge 22. Each such binder attachment tab 18 may have at least one respective tab hole or opening 25 formed therein, through which a given binder ring 38 may be received and thereby joined with a respective binder attachment tab 18. Each cover 12, 14 may include a plurality of discreet spaced tabs 18 extending outwardly from an associated free cover edge 24, and the cover 12, 14 may lack any structure positioned between each tab 18 in a direction generally parallel to the associated free edge 24 (i.e. such that a gap is present between each tab 18).

As seen from FIGS. 2 and 3, upon joinder of at least one given binder ring 38 with a corresponding binder attachment tab 18, the bound component 10 and the multi-ring binder 30 may thereby be interconnected. In one case there is a one-to-one ratio between binder rings 38 and tabs 18 such that each ring 38 is received through a tab 18, and each tab 18 receives a ring 38 therethrough. Further notable is the placement of the binder attachment tabs 18 in a manner so that they may extend from a free cover edge 24. In the illustrated example, the bound component 10 may be side-bound, with the bound cover edge 22 being adjacent the side-mounted binding mechanism 16 and with the free cover edge 24, with which the binder attachment tabs 18 are associated, being parallel and opposed relative to the bound cover edge 22. Due to the configuration/placement of the binder attachment tab(s) 18 (i.e., being placed away from a given bound cover edge 22/binding mechanism 16), pivot locations of the binding mechanism 16 of the bound component 10 and the binder spine 36/binder rings 38 may, essentially, not coincide (i.e., interference therebetween is thereby avoidable).

By avoiding the coincidence of such pivot locations, the binding mechanism 16 of the bound component 10 may have a free range of motion, limited only by, e.g., the surface (not shown) upon which it rests and not by the binder rings 38. In one case, for example, each page 20 (and the cover 14 in the embodiment of FIGS. 1-3) is pivotable by at least about 180 degrees relative to a plane defined by the cover 12. Accordingly, the bound component 10 may, due to such construction, may be folded out flat, even while attached to the multi-ring binder 30. Thus, it is to be understood any pivot-based stationery item (e.g., the bound component 10, a folder, etc.) may benefit from the use of the appropriately placed binder attachment tabs 18, as described herein, to allow such item to be folded out flat. Further, if the bound component 10 is, for example, a notebook, pages can be removed therefrom (i.e., by tearing the pages 20 from the binding mechanism 16) even while the notebook is mounted in the multi-ring binder 30, without creating additional tear locations due to the binder rings 38.

Figure 4:
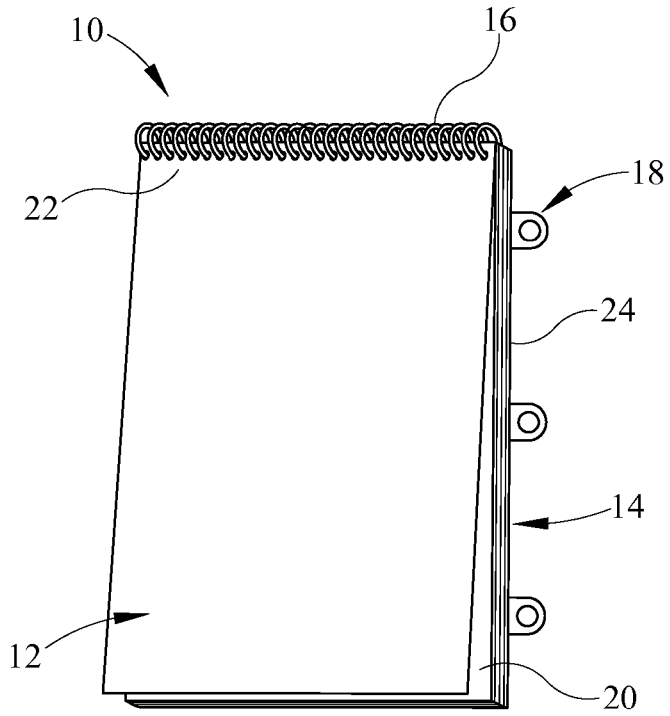
FIG. 4 is a top plan view of a further aspect of the disclosed cover construction, employed with a bound component such as a notebook, in which the binder attachment tabs extend from a free, unbound edge (e.g., a side edge in this instance) of the cover and in which the binding mechanism extends along the top of the bound component.

In addition to the arrangement shown in FIGS. 2-3, the avoidance of the coincidence of the pivot locations may also be achieved, for example, by placement of the binding mechanism 16 at the top of the bound component 10, as shown in FIG. 4, and having the binder attachment tab(s) 18 extend from a free cover edge 24 perpendicular to the bound cover edge 22/binding mechanism 16. It is to be understood that the free cover edge 24 of this embodiment could be any edge other than the edge 22 containing or adjacent to the binding mechanism 16. For example, the free edge 24 could be, with reference to the binding mechanism 16, a right, left, or, even potentially bottom, edge.

Figure 5:
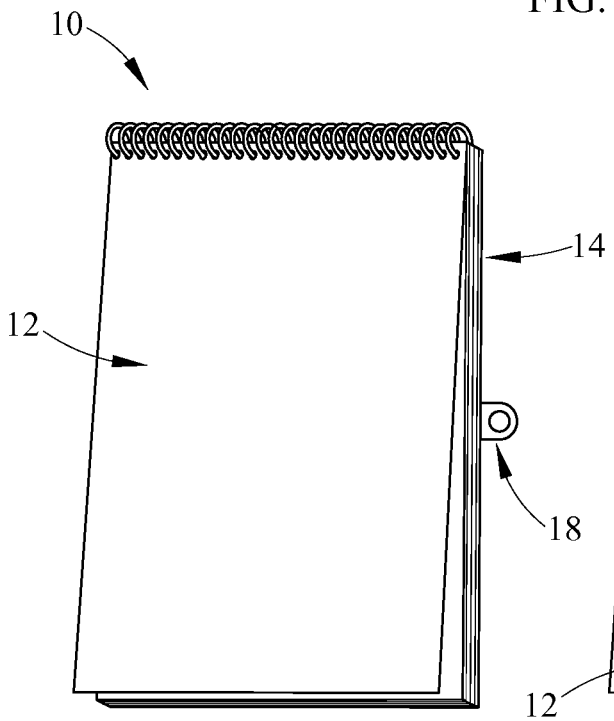
FIG. 5 is a top plan view of a first variation of the disclosed cover construction, employed with a bound component such as a notebook, in which a single binder attachment tab is employed.
Figure 6:
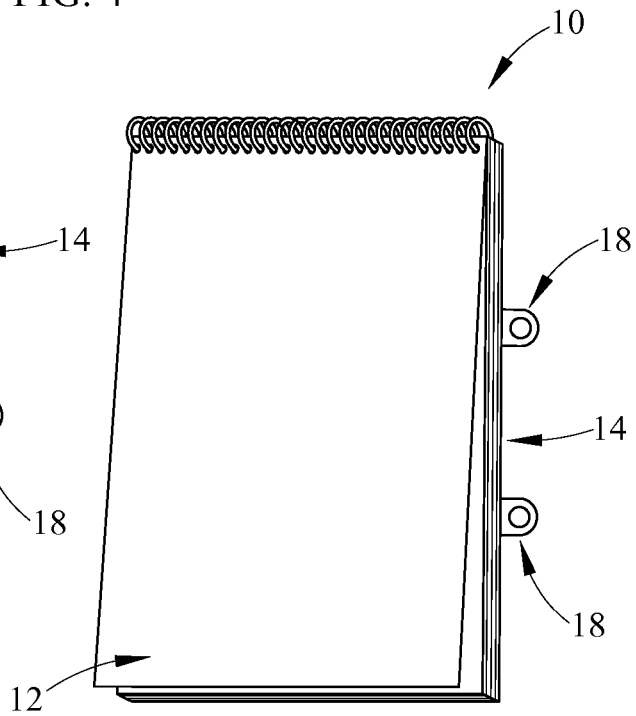
FIG. 6 is a top plan view of a second variation of the disclosed cover construction, employed with a bound component such as a notebook, in which two binder attachment tabs are employed.
Figure 7:
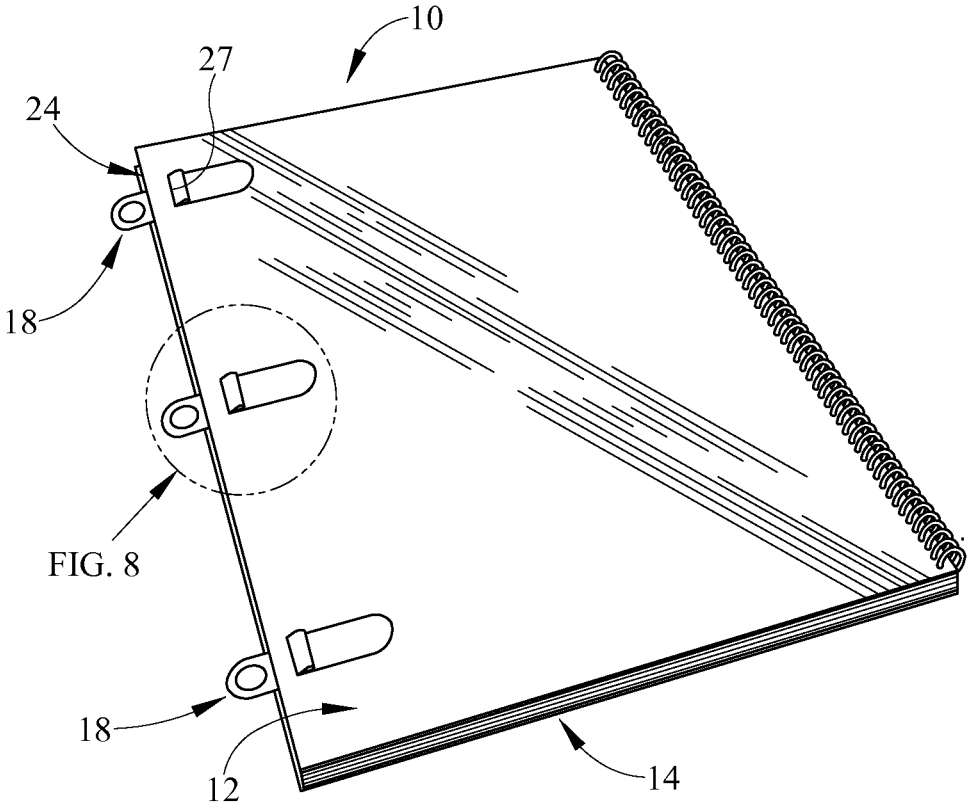
FIG. 7 is a top view of a second embodiment of the disclosed cover construction, employed with a bound component such a notebook, in which the cover incorporates at least one foldable binder attachment tab.
Figure 8:
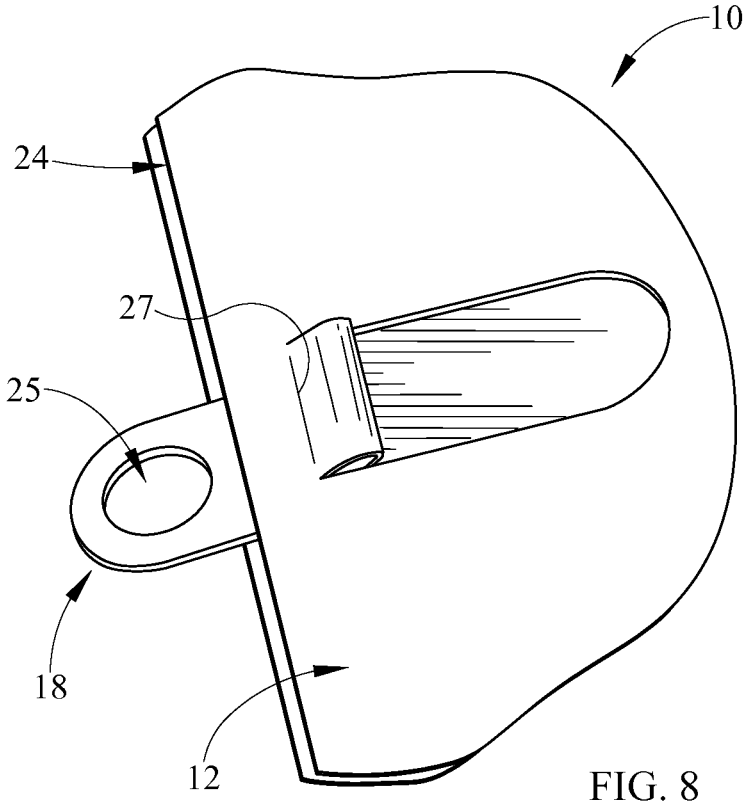
FIG. 8 is an enlarged perspective view of the circular region "8" indicated in FIG. 7, which more closely depicts one possible way to fold a binder attachment tab.
Figure 9:
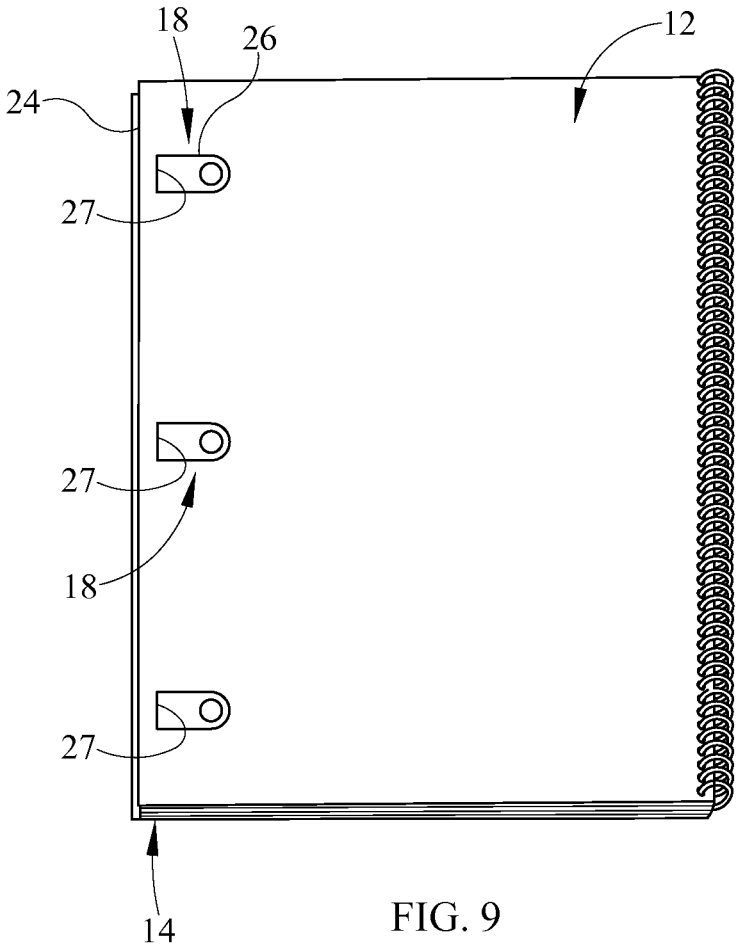
FIG. 9 is a top view of a bound component (e.g., a notebook) employing the cover construction as shown in FIG. 7, prior to any given binder attachment tab thereof being deployed and folded out for use.

FIGS. 5 and 6 further illustrate that a given first cover 12 may include any of a various number of binder attachment tabs 18, including at least one. It is further understood that a given second cover 14 could be similarly constructed. Additionally, although each binder attachment tab 18 is shown with one tab hole 25, it is to be understood that each attachment tab 18 could accommodate more than one such tab hole 25 therein, e.g., to accommodate two or more binder rings 38, such as in an instance in which two or more binder rings 38 are rather closely spaced (e.g., within about 1-2 inches).

An example of a coated paper board that may be used to form the covers or dividers or other such embodiments may be found in U.S. Pat. No. 7,144,635 and U.S. patent application Ser. No. 11/545,842 both assigned to MeadWestvaco Corporation. Such paper board may have tear-resistant features which would provide added strength to the one or more tab components.

Also, one of ordinary skill in the art will further recognize that the exact size and shape of a given binder attachment tab 18 may be chosen to suit the application, e.g., based on needed strength, aesthetics, etc. Further, the particular placement of the binder attachment tabs 18 may be chosen to suit the application, e.g., given the number and/or placement of the binder rings 38 to which the tabs 18 may, respectively, be bound. Additionally, it is understood that the binder attachment tabs 18, in addition to being incorporated/attached to a given bound component 10 by a manufacturer or secondary producer, could be provided separately to consumers for attachment to a bound component 10 not initially provided therewith (i.e., retrofitting is possible).

FIGS. 7-14 serve to illustrate various potential embodiments for the connection of the binder attachment tabs 18 to a given first or second cover 12, 14 (with only a first cover 12 shown, for simplicity). A second tab embodiment may be seen in FIGS. 7-11. As per this embodiment, each binder attachment tab 18 may be integrally formed within the first cover 12 at a position near but spaced away from at the associated free cover edge 24. In particular, a given binder attachment tab 18 may be initially defined by a weakened, semi-weakened or tearable (e.g., selectively thinned or perforated) boundary 26 (see FIG. 9; e.g., U-shape, 3-sided block, star or any other shape so long as there is one non-perforated/non-weakened edge 27, etc.).

The given binder attachment tab 18, as thus initially provided, may provide a perimeter edge not compromised by any perforation/area of weakness. This non-weakened edge thereof may thereby define a tab fold line 27 of a corresponding binder attachment tab 18. Thus, in the present context, "semi-weakened" may more particularly refer to the boundary 26, as a whole, indicating only a portion thereof is weakened relative to the rest of the cover 12 and not necessarily implying the degree of weakening of such a portion. Additionally, in this embodiment, the first or second cover 12, 14 and the corresponding binder attachment tabs 18 may be formed of a same material (e.g., coated or uncoated paper board, plastic, etc.). By way of a more specific example, the material may be a natural Kraft paper or polypropylene.

Furthermore, it is to be understood that the tab fold line 27 may be parallel to a corresponding free cover edge 24 to permit a given binder attachment tab 18 to fold out in a direction perpendicular to the corresponding free cover edge 24. Alternatively, the tab fold line 27 and, further optionally, the orientation of the semi-weakened boundary 26 may be angled relative to a corresponding free cover edge 24 to yield a complementarily angled fold of a given binder attachment tab 18. The latter alternative would allow, for example, a given binder attachment tab 18 to be located more to the interior of a given first or second cover 12, 14 and still reach a position more toward an extremity of the particular first or second cover 12, 14.

Additionally, it is to be understood that at least the area proximate a given tab fold line 27 (both in the binder attachment tab 18 and the corresponding cover 12, 14 but not on the boundary 26) may be reinforced on one or both faces thereof by any of a variety of means. Potential reinforcement mechanisms may include, for example, a backing tape (such as Mylar® tape, i.e., a thin strong polyester film); a reinforcing filler mixed into the pulp, when using a paper board material; a further coating; a separately attached substrate material (e.g., paper board or plastic); and/or a folded-over cover edge (i.e., creating double thickness in tab regions).

Once a given binder attachment tab 18 is punched out along the respective semi-weakened boundary 26, it may be folded outwardly along the tab fold line 27, toward the corresponding free cover edge 24. Accordingly, the binder attachment tab 18 of this embodiment may be designed to be of a sufficient length so as to extend, upon deployment thereof, from an interior position of the first or second cover 12, 14, across the proximate free cover edge 24, and then out to a location that may permit total exposure of the opening 25 and connection of the binder attachment tab 18 with a corresponding binder ring 38.

One of ordinary skill in the art will recognize that any such given binder attachment tab 18 could be folded toward the back or front of a given first or second cover 12, 14 and still be deployed in the desired fashion. Yet further, although not expressly shown, a mechanism by which a given binder attachment tab 18 may be held in place may also be provided. That interlocking mechanism could, for example, be in the form of a notch, a loop, an adhesive surface, a hook and loop fastener, etc., located on the tab 18 and/or body of the cover 12, 14.

Figure 10:
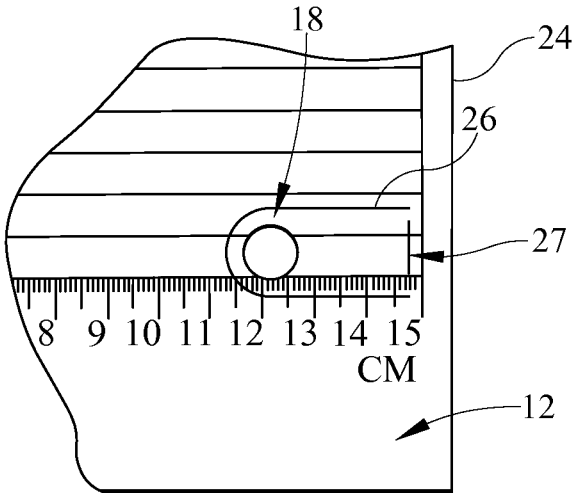
FIG. 10 is a partial bottom view of the cover shown in FIG. 7, illustrating printing on the inner surface of the cover in the region of a foldout binder attachment tab.

From FIG. 10, it may be seen that printing or indicia (e.g., a ruler scale in the example shown) may be provided on and in the region of a given punch-out binder attachment tab 18. Such printing can, potentially, be arranged so as to remain viewable even after the associated binder attachment tab 18 is deployed. One possible means to preserve such printing, displayed perhaps on the inside of a cover, would be to provide a cover having two sides, where the internal side of the cover does not have a perforated binder attachment tab and the outer layer does have a perforated binder attachment tab. With such a structure, the internal side of the cover may be loosely connected around the overlapped region of the printing, on the internal side of the cover, and the binder attachment tab as perforated on the outside of the cover. Designed as such, the binder attachment tab 18 may be able to fold in either direction, to the outside or to the inside sliding between the internal and outer layers of the cover and protruding from the cover through an opening on the cover's edge. It is to be understood that such a design would allow one to deploy the tabs without disrupting the internal printed material. It is to be understood that such printing could, e.g., be provided on either/both faces of a given first or second cover 12, 14. Likewise, the printing could, for example, be similarly be provided on both the first and second covers 12, 14, thereby being available for viewing on a given cover 12, 14 for which a printing-proximate binder attachment tab 18 is not deployed.

Figure 11:
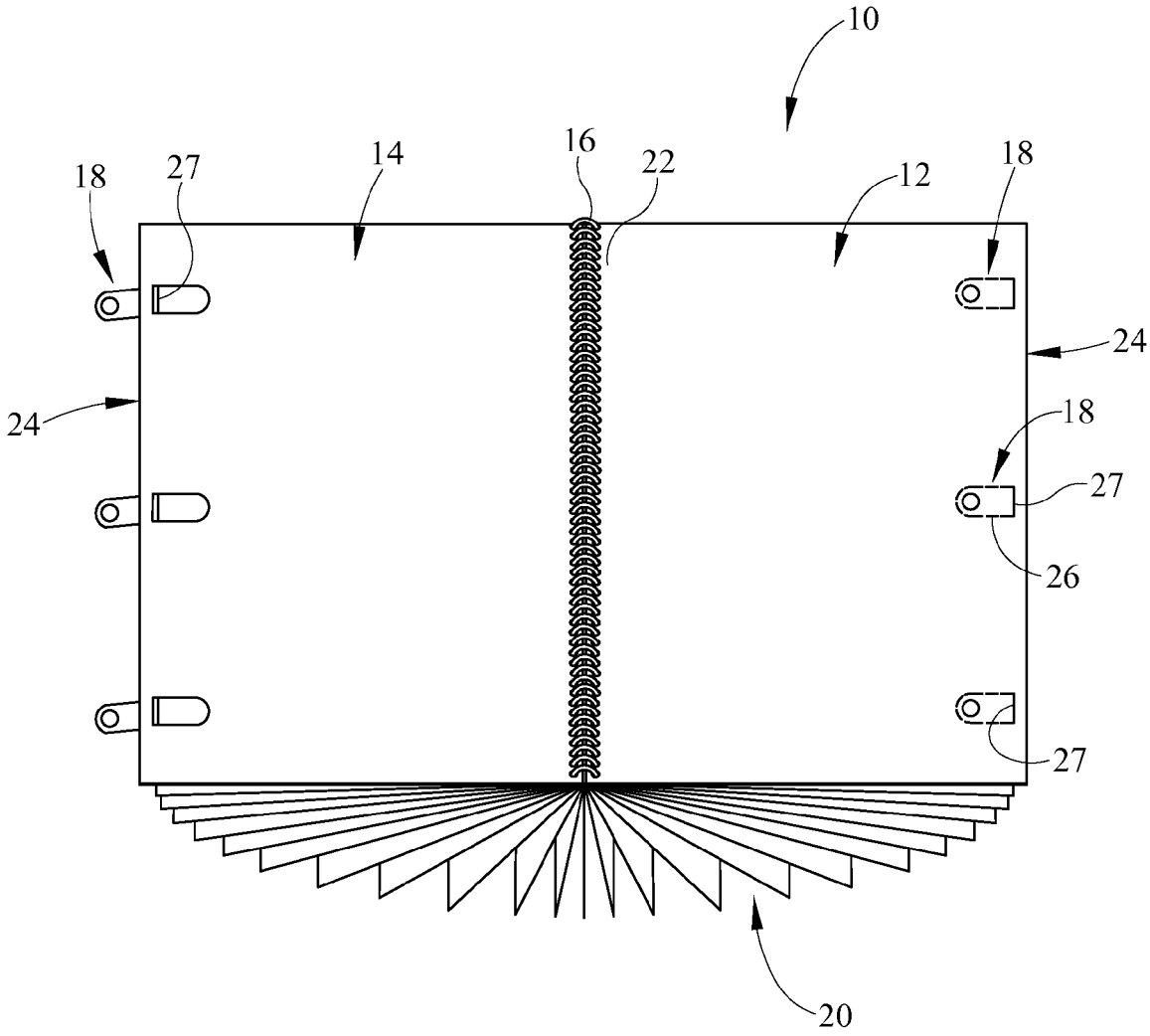
FIG. 11 is a bottom perspective view of a bound component, such a notebook, incorporating the cover construction of the second embodiment, showing a plurality of binder attachment tabs associated with each respective cover and illustrating the selectively deployable nature thereof.

Referring to FIG. 11, the bound component 10 using the second tab embodiment may include first and second covers 12, 14, with each having at least one punch-out binder attachment tab 18 associated therewith. Since the first and second covers 12, 14 each have at least one respective punch-out binder attachment tab 18, the user may choose which, if any, of the binder attachment tabs 18 should be deployed on a given cover 12, 14 at any given time. By way of example only, the binder attachment tabs 18 of the second cover 14 might be deployed, while those of the first cover 12 may be left undeployed. It is to be understood also that the bound component 10, as shown, may generically define a pivotable stationery item. As such, the second tab embodiment may also be employed with, e.g., a folder or another pivoting stationery item.

Figure 12:
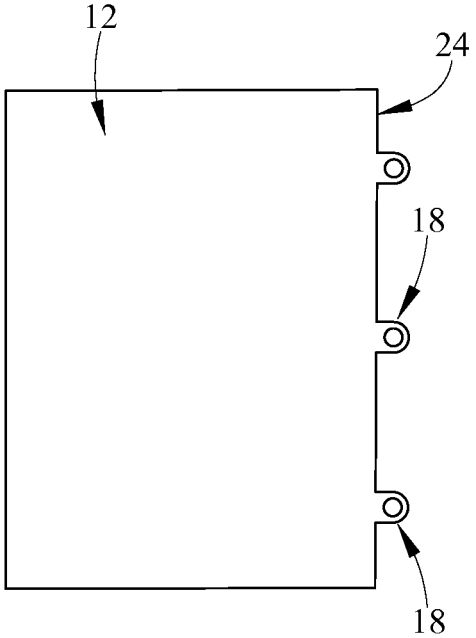
FIG. 12 is a top view of a third embodiment of the disclosed cover construction, in which the cover incorporates at least one integral binder attachment tab.
Figure 13:
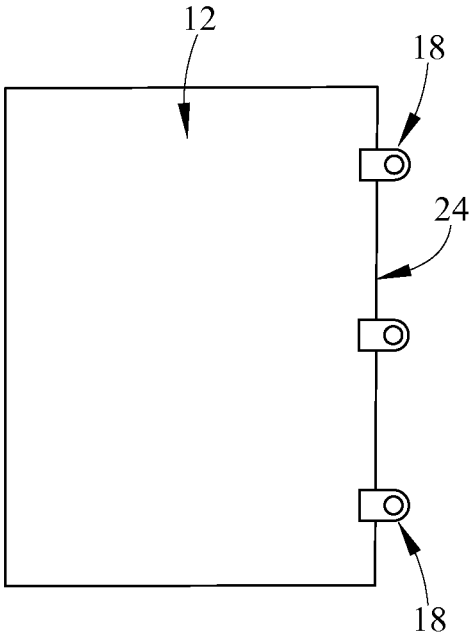
FIG. 13 is a top view of a fourth embodiment of the disclosed cover construction, in which the cover incorporates at least one binder attachment tab that is adhered or otherwise attached thereto.
Figure 14:
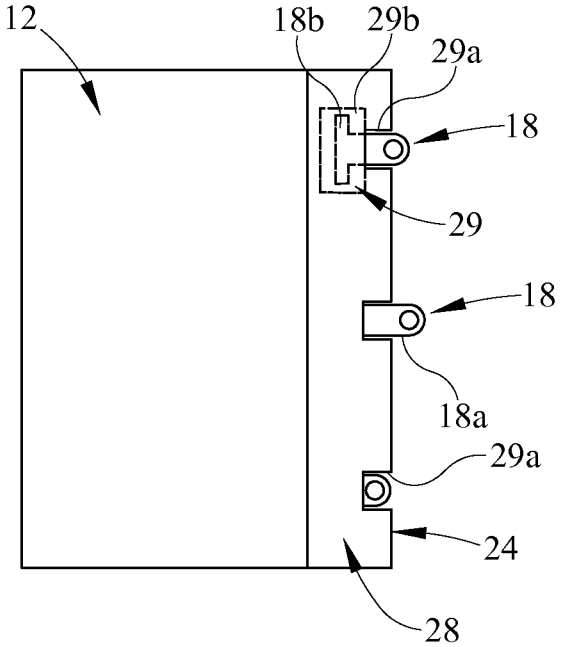
FIG. 14 is a top view of a fifth embodiment of the disclosed cover construction, in which the cover incorporates at least one sliding, retractable binder attachment tab.

Other tab embodiments may be available, as seen from FIGS. 12-14. Referring to FIG. 12, in the third tab embodiment the binder attachment tabs 18 extend integrally from a given free edge 24 of a first or second cover 12, 14. In this case, each tab 18 is integrally or unitarily, and seamlessly, formed from a single piece of material with the rest of the cover 12. In addition, the cover 12 may be substantially continuous adjacent to each tab 18; i.e. the cover 12, 14 may lack any openings or the like adjacent to each tab 18 to ensure that the cover 12, 14 has sufficient strength and structural integrity adjacent to the tabs 18. For example, in one embodiment each tab 18 has a tab width measured generally perpendicular to the associated edge (edge 24 in the embodiment of FIG. 12), and the cover 12, 14 lacks any openings or the like (that are not located in the tabs 18 themselves) located a distance less than a tab width from any of the tabs 18.

Each tab 18 may be seamlessly connected to a main body of the cover 12, 14 such that the cover 12, 14 lacks any hinge line positioned between the tab 18 and the main body of the cover 12, 14. The presence of seams/hinge lines may allow the tab 18 to be more easily torn off, and may make it more difficult to pivot the bound component 10 about the rings 38 of the binder 30 since the tabs 18 might lag behind when the bound component 10 is pivoted about the rings 38.

It is to be understood that any various means (e.g., cutting, gel molding, injection molding, net-shape manufacturing, and/or another known production process) for producing an integral set of binder attachment tabs 18 may be used in concert with the third tab embodiment. Like in the first and second tab embodiments, the first or second cover 12, 14 and the corresponding binder attachment tabs 18 may be formed of a same material (e.g., paper board, plastic, etc.). Further, such a binder attachment tab 18 may have any size, shape, placement, number of tab holes 25, etc., as deemed necessary.

The fourth tab embodiment, as per FIG. 13, may provide the attachment of the binder attachment tabs 18 proximate a given free edge 24 of a first or second cover 12, 14. Such attachment may be achieved by, for example, an adhesive means (e.g., glue, tape, etc.) and/or a mechanical means (e.g., staples, rivets, stitching, sewing, hook and loop fasteners (i.e., Velcro® fastening material), etc.). The degree of permanence desired for such attachment may be achieved by the chosen fastening/attachment means. In this case the binder attachment tabs 18 are not unitarily or integrally formed as a single piece of material with the remainder of the associated cover 12/14.

A rivet or single point used as the attachment mechanism offers the benefit of a pivotable attachment, thereby permitting the angle of a given binder attachment tab 18 to be radially adjusted, and effectively permitting selectable pivotable retraction and/or lateral/angular positioning thereof relative to any given binder ring 38. If a rivet is, for example, used as the attachment mechanism and the binder attachment tab 18 is further provided with a longitudinally-extending rivet engagement slot (not shown), selectable slide and pivot (i.e., XYθ) positioning of the tab 18 may be possible. It should be, likewise, understood that other attachment means may be utilized that would otherwise facilitate a linearly and/or rotationally adjustable attachment. Also, other means for adjusting the effective length of a given binder tab 18 could be incorporated.

Furthermore, it is to be understood that the binder attachment tabs 18, especially as provided in fourth tab embodiment, could be mounted by the initial manufacturer, a secondary production facility, and/or an end user, and such binder attachment tabs 18 do not necessarily have to be made of the same material as the first and/or second cover 12, 14.

The fifth tab embodiment, as illustrated in FIG. 14, may allow for a slide-mount of the binder attachment tabs 18. In this embodiment the first or second cover 12, 14 may incorporate an additional slide accommodation strip 28 attached thereto along a desired free cover edge 24. The first or second cover 12, 14 and the slide accommodation strip 28 together may define a retractable slide zone 29. The retractable slide zone 29 may include a relatively narrow slide adjustment notch 29*a* adjacent to the free edge 24 and a relatively wide slide retaining region 29*b* spaced away from the free edge 24. The binder attachment tabs 18 of the fifth embodiment may include a relatively narrow main tab extension 18*a* adjacent to the tab hole 25 and a relatively wide tab retaining portion 18*b* spaced away from the tab hole 25.

The slide retaining region 29*b* accommodates the sliding of the tab retaining portion 18*b*. As such, the slide retaining region 29*b* may have a width permitting the slide fit of a respective tab retaining portion 18*b* therein. Additionally, the slide retaining region 29*b* may have a depth sufficiently exceeding that of the respective tab retaining portion 18*b* so as to permit adjustment of the respective main tab extension 18*a* relative to a given free cover edge 24. Given that the width of the slide retaining portion 29*b* may be much greater than a corresponding main tab extension 18*a* and/or slide adjustment notch 29*a*, the fifth tab embodiment may allow for slide positioning of a given binder attachment tab 18, of which three different slide positions are shown in FIG. 14. As will be appreciated by one of ordinary skill in the art, slide-mounting of the binder attachment tabs 18, in general accordance with the fifth embodiment, may permit for any of a variety of effective tabbing lengths to be chosen (i.e., allowing distance from the binder rings 38 to be adjusted).

The slide adjustment notch 29*a* may extend through both the slide accommodation strip 28 and the respective first or second cover 12, 14, or through just one of the two. The slide adjustment notch 29*a* may facilitate the manual positioning of a given main tab extension 18*a* to the desired location relative to the corresponding free cover edge 24. Finally, it is to be understood that the materials used for the first or second cover 12, 14, the binder attachment tabs 18, and/or the slide accommodation strip 28 may be, for example, paper board (e.g., coated or uncoated natural Kraft board), plastic (e.g., polypropylene), a composite, or another suitable material and various combinations of materials. Additionally, such binder attachment tabs 18 could, instead, be incorporated in a separately produced insert unit that could then be attached to a given first or second cover 12, 14, or such binder attachment tabs 18 could be sandwiched between a pair of boards (e.g., slide accommodation strip 28) and pulled out from therebetween.

Figure 15:
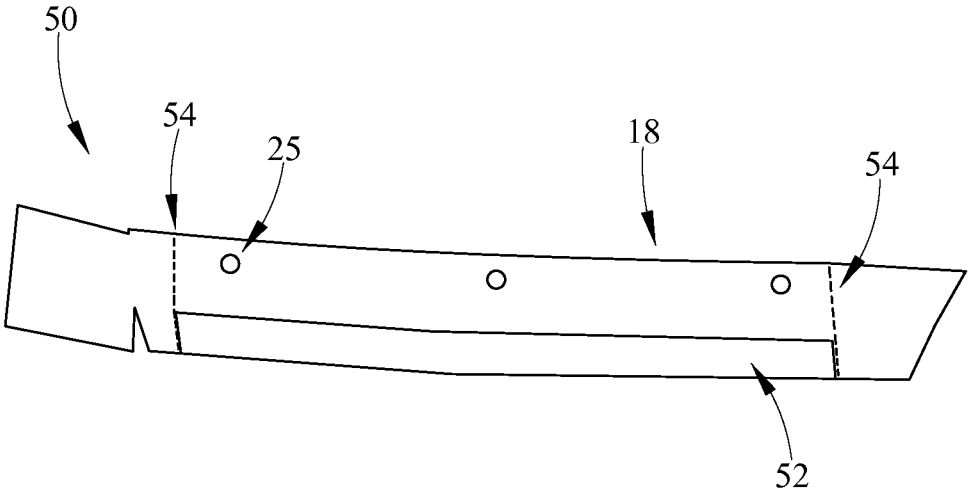
FIG. 15 is a top perspective view of a yet another embodiment of the binder attachment tab, similar to that the third embodiment of the disclosed cover construction, in which a peel-off strip permits exposure of an adhesive and in which perforations are available for the separation of the binder attachment tab from either a cover, a board, an extended strip containing one or more similar binder attachment tabs, or some other source.
Figure 16:
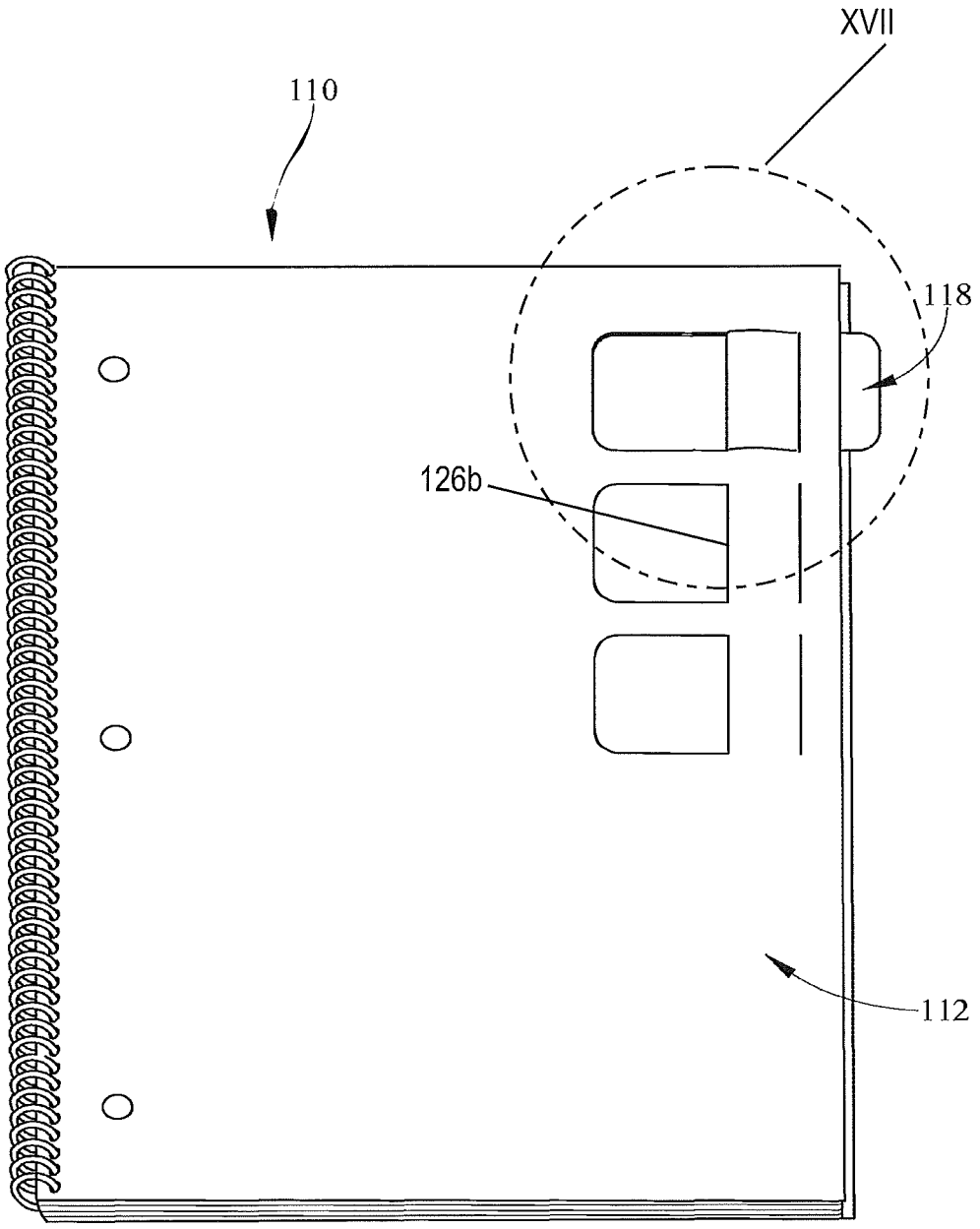
FIG. 16. is a top isometric view of yet a further embodiment of the disclosed tabbing construction, employed, e.g, with a cover/divider of a bound component such a notebook, in which the tabbing is in a form of at least one foldable identifier tab.
Figure 17:
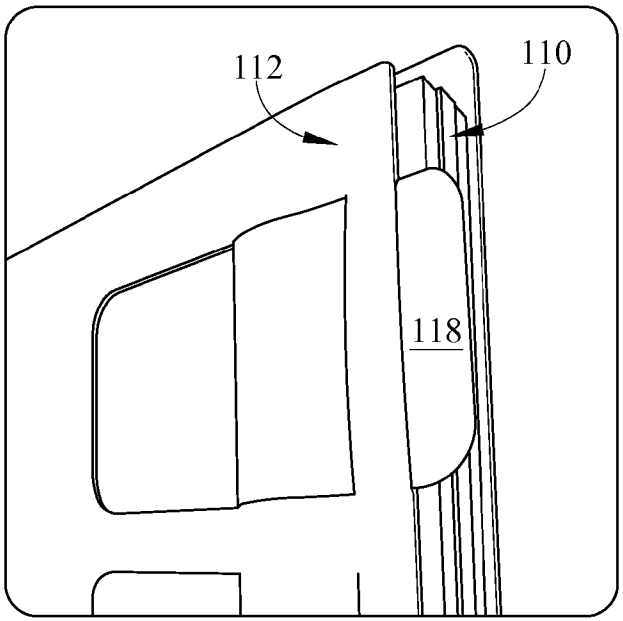
FIG. 17 is an enlarged perspective view of the encircled corner region "XVII" indicated in FIG. 16, which more closely depicts one possible way to deploy a given identifier tab.

FIG. 15 illustrates that a binder attachment tab 18 may, for example, be a strip 50 containing multiple holes and including an adhesive/glue 52, to facilitate attachment thereof to given first or second cover 12, 14. The adhesive may be protected by a peel off strip that could cover the entire strip 50, the portion between the perforations 54, or just the glue portion 52. Further, perforations 54 may be available for removal of the actual binder attachment tab 18 from the larger strip 50. It is to be understood, however, that the strip 50 could be produced to the same desired length of the given binder attachment tab 18 such that no perforation are necessary. It is also to be understood that other modifications to the length either longer or shorter than the binder cover could be produced. Additionally, although the binder attachment tab 18 of FIG. 15 is shown to have three tab holes 25, it is to be understood that any number of such tab holes 25 could be employed, as per the desired use.

The bound component 110, the dividers/covers 112 (one of which is shown), and the related identifier tabs 118 illustrated in FIGS. 16-20 may be similar to the bound component 10, the covers/dividers 12, 14, and the binder attachment tabs 18. For example, each identifier tab 118 may be formed within a given divider 112, with a weakened boundary portion 126*a* (FIG. 18) and a non-weakened boundary portion 126*b*. A primary difference in function between a given identifier tab 118 and a given binder attachment tab 18 may be that an identifier tab 118 may be used, for example, to facilitate organization and/or identification of sections of a bound component 110. To be readily viewable by a user, a given identifier tab 118 may be deployable proximate a given free (i.e., non-binder) edge 124 of a particular divider 112. Each identifier tab 118 could be, potentially, written or printed upon, receive a sticker/label, etc., to permit organization/identification (e.g., by subject or topic) of a given section of a bound component 110. Further, since the primary function of a given identifier tab 118 is not one of attachment, a given identifier tab 118 need not necessarily be supplied with any tab hole punch-out area, although it could be (i.e., possibly making tabs 18, 118 interchangeable to at least some degree).

Figure 19:
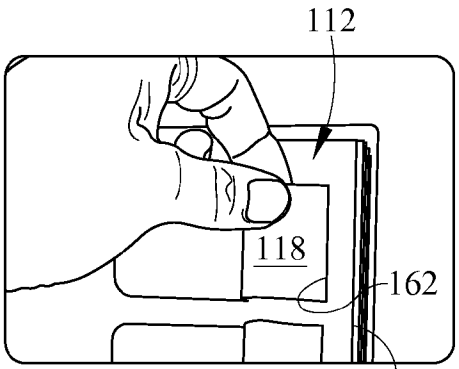
FIGS. 18-20 illustrate a series of steps involved in deploying a given identifier tab, as per the final position indicated in FIG. 17.
Figure 18:
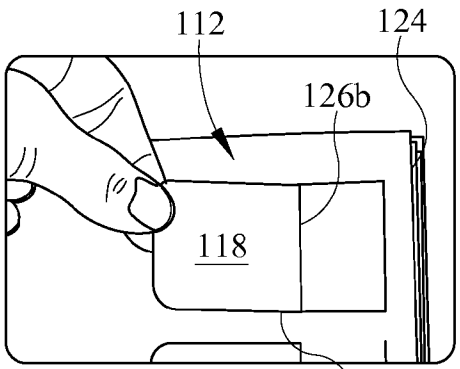
Figure 20:
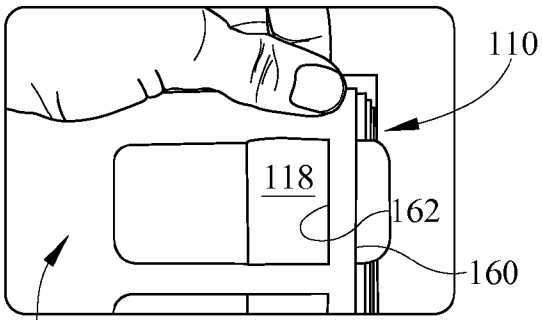

FIGS. 18-20 illustrate a potential method of deploying a given identifier tab 118, as well as the structural features which may be associated with a given divider 112 proximate such an identifier tab 118. Specifically, as previously indicated, a particular identifier tab 118 may be defined by the weakened boundary portion 126*a* and the non-weakened boundary portion 126*b* thereof. At the free edge 124 proximate a given identifier tab 118 may be an edge slot 160, and between the free edge 124 and the non-weakened boundary portion 126*b* may be an interior slot 162. It is to be understood that each slot 160, 162 may be a through slot or an area of weakness (e.g., perforations) readily formed into a slot, as needed, and may be configured for receiving the corresponding identifier tab 118 therethrough. It is noted that an edge slot 160 may be able to be formed, for example, in a divider folder with a distinct fold (not specifically shown) at a select free edge 124 thereof. If a simple, unfolded divider 112 is employed, an interior slot 162 could alone be employed, or a second interior slot 162 (not shown), closer to the free edge 124, could be provided, to be used similar to an edge slot 160.

Potential variants may be possible. For one, by using a center-folded divider for a given divider (e.g., 12, 14, 112), a given divider essentially may have two pages, allowing a particular identifier tab 118 to be punched out from one page with the opposed page limiting the view through the open tab space in that one page. Further, a given divider, whether center-folded or not, may be supplied with at least one pocket. It is also understood that the dividers may be built-in to a given bound component 10, 110 or marketed separately as inserts. Such inserts could be hole-punched or provided with some other means of permitting linkage with a bound component 10, 110. It is also to be understood that a traditional two-pocket folder may be updated to add deployable tabs that may be used for organizational purposes as described above, for attachment purposes using the tab and hole punch method described above or both. It is to be understood that other types of folders may have the tabs discussed added to them as well. It is also to be understood that the deployable and/or permanent tabs may be treated (for writing purposes) or structurally strengthened or have added materials. It is to be understood that plastic clips or clips made of see through material or any other type of see through material could be added to any of the tabs described above to protect the tabs or the contents written on the tabs or to hold slips of paper over the tabs.

Figure 22:
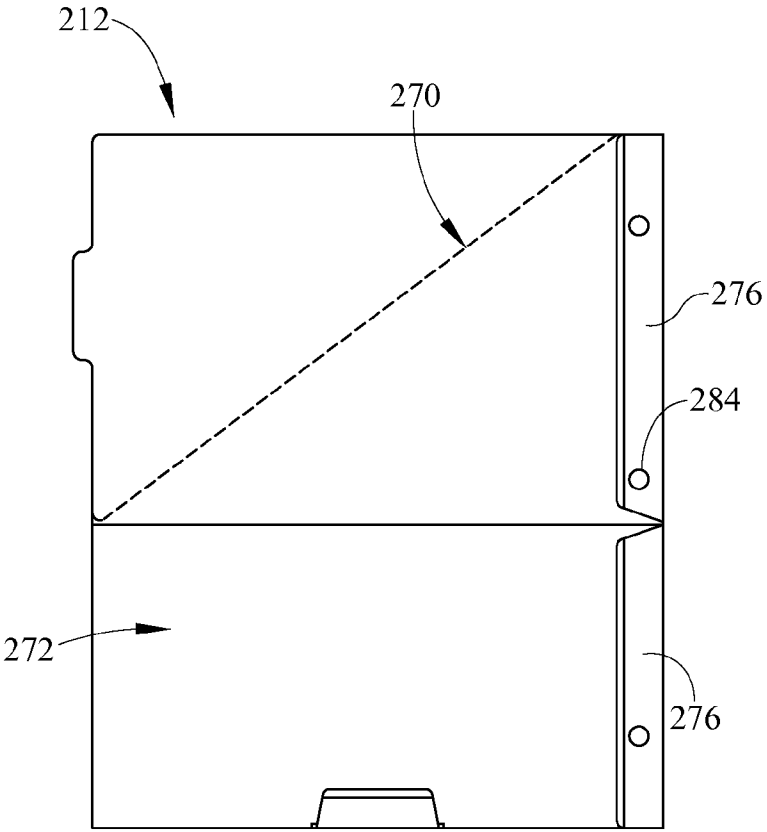
FIG. 22 is a back assembled view of one of the dividers shown in FIGS. 21.
Figure 21:
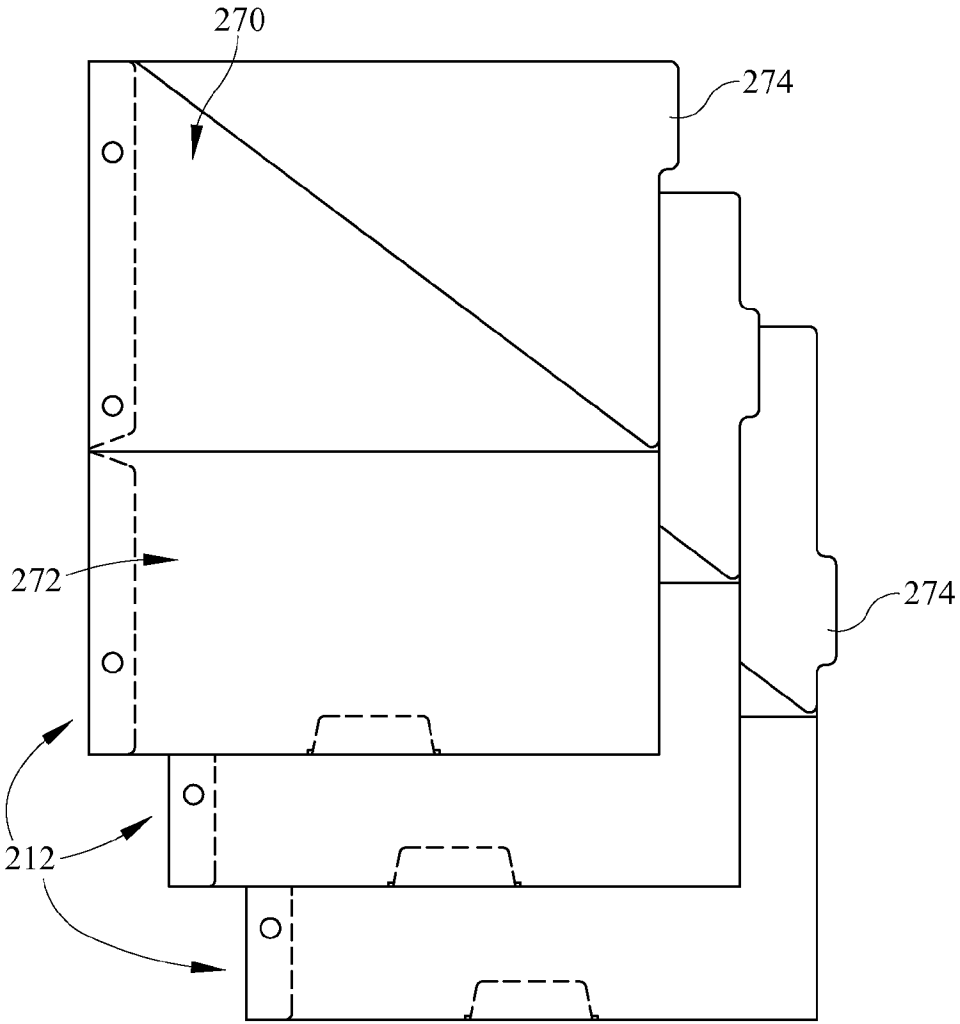
FIG. 21 is a front assembled view of a set of three dividers according to yet another embodiment.
Figure 23:
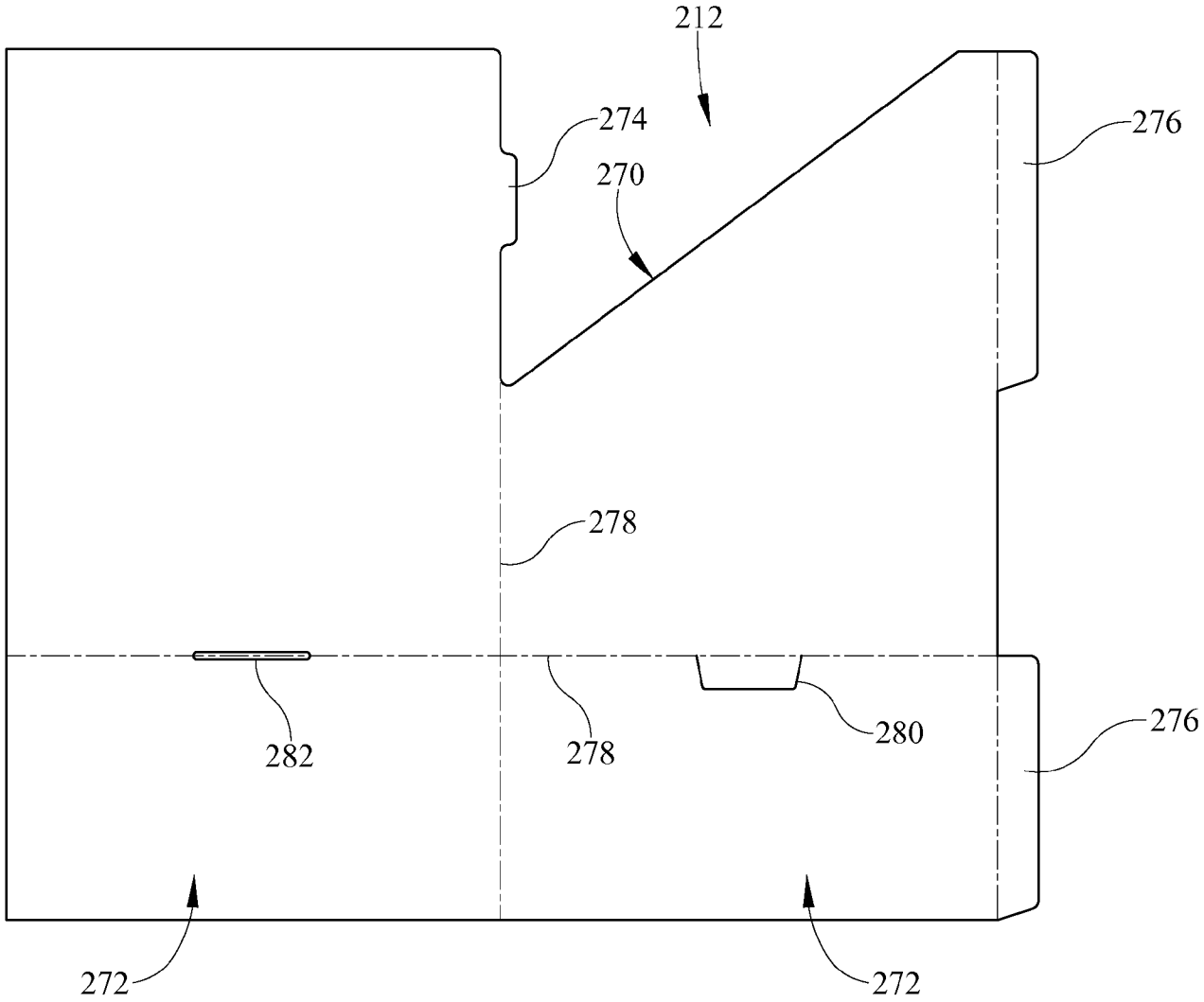
FIG. 23 is a plan view of an unassembled one of the dividers shown in FIG. 21.

FIGS. 21-23 illustrate another embodiment of a divider 212, in particular one of a three-pocket design. As can be seen from FIG. 23, a given divider 212 may be formed from a single sheet of material (e.g., polypropylene or paperboard) and may include a large pocket 270 and two small pockets 272. Each divider 212 may further include at least one tab 274 (e.g., permanently positioned, as shown, or selectively deployable like an identifier tab 118); sealable side flaps 276 (e.g., heat-welded and/or adhesively-bonded); crease/fold lines 278 to permit the necessary folding to form the three pockets 270, 272; a bottom closure tab 280; a tab slot 282; and/or hole-punches 284. The bottom closure tab 280 may be, e.g., die-cut or otherwise readily deployable from a first small pocket area 272, in much the same manner as tabs 18, 118 described above. Further, the bottom closure tab 280 can be inserted through a related tab slot 282 to permit placement thereof against the second small pocket 272. Once in place, the bottom closure tab 280 can be sealed to the second small pocket 272, thereby helping hold the bottoms of the small pockets 272 together and make the divider 212, overall, more stable. It is to be understood, for example, that such a divider 212 could be made to any desired size and/or that the shape of the pockets 270, 272 could be adjusted according to the desired use.

Additionally, it is to be understood that further variations on the above-mentioned versions and embodiments may be possible. For one, each of the various embodiments of the binder attachment tabs 18 may be further reinforced on one or both faces thereof by any of a variety of means. Potential reinforcement mechanisms may include, for example, a backing tape (such as Mylar® tape, i.e., a thin strong polyester film); a reinforcing filler mixed into the pulp, when using a paper board material; a further coating; a separately attached substrate material (e.g., paper board or plastic); and/or a folded-over cover edge (i.e., creating double thickness in tab regions).

Secondly, the cover 12, 14 and/or the bound component 10 may be provided with pockets (e.g., open or zippered) (not shown) to facilitate storage/carrying of such items as a calculator, a cell phone, a PDA, pens, pencils, scissors, sticky notes, erasures, note pads, etc. Further, in each of the variations, it is to be understood that the tab holes 25 may so as to be selectably punched out (e.g., initially perforated within a given binder attachment tab 18). Finally, it is contemplated that the first or second cover 12 could serve as a cover, divider, backing, etc., so long as such is generally used in the context of provided herein.

Having described the invention in detail and by reference to the various embodiments, it should be understood that modifications and variations thereof are possible without departing from the scope of the invention.

What is claimed is:

1. A bound system comprising:

a plurality of pages;

a front cover/divider and a back cover/divider, at least one of said cover/dividers including a bound outer edge and a plurality of free outer edges, wherein said at least one cover/divider is bound to said plurality of pages along said bound edge, wherein said at least one cover/divider is configured to have one or more discrete tabs integrally formed from within the cover/divider at a position spaced away from the associated outer cover/divider edge and initially defined by semi-weakened boundary which includes a tab fold line, said one or more discrete tabs deployable by folding along said tab fold line to a configuration extending the tab generally outward relative to one of said free edges, each tab being integrally formed from a single piece of material with the rest of said at least one cover/divider, each tab further having an opening formed therethrough each opening being configured to receive at least part of a binding device therethrough to thereby couple said at least one cover/divider to said binding device; and a wire coil binding mechanism binding said plurality of pages to said at least one cover/divider along said bound edge, and wherein said tabs are positioned on an opposite side of said at least one cover/divider relative to said binding mechanism

2. The system of claim 1 further comprising a binding device having a plurality of rings, wherein one or more rings are received through an associated one of said tabs to couple said at least one cover/divider to said binding device.

3. The system of claim 1 wherein said at least one cover/divider is substantially continuous adjacent to each tab and lacks any openings adjacent to each tab.

4. The system of claim 1 wherein said at least one tab is seamlessly connected to a main body of said at least one cover/divider such that said at least one cover/divider lacks any hinge line positioned between said at least one tab and said main body of said at least one cover/divider.

5. The system of claim 1 wherein said binding mechanism extends generally an entire length of said bound edge.

6. The system of claim 1 wherein said at least one cover/divider includes a plurality of discrete spaced tabs positioned on said one of said free edges, wherein said at least one cover/divider lacks any structure positioned between each tab in a direction generally parallel to the associated free edge, other than the structure of the cover/divider.

7. The system of claim 1 wherein said at least one cover/divider is shaped and sized to generally cover an outer one of said plurality of pages when said at least one cover/divider is in a closed position, and wherein the other one of said cover/dividers is shaped and sized to cover another outer one of said plurality of pages when said other cover/divider is in a closed position, and wherein said other cover/divider is spaced apart from and not directly coupled to said at least one cover/divider.

8. A system comprising a cover/divider including a bound outer edge and a plurality of free outer edges, wherein said cover/divider is configured to be bound by a wire coil binding mechanism to a page along said bound edge such that said page is pivotable by at least about 180 degrees relative to a plane defined by said cover/divider, wherein said cover/divider configured to have one or more tabs integrally formed within the cover/divider at a position spaced away from the associated outer cover/divider edge and initially defined by semi-weakened boundary which includes a tab fold line, said one or more discrete tabs deployable by folding along said tab fold line to a configuration extending generally outward relative to one of said free edges, said one or more tabs being integrally formed from a single piece of material with the rest of said cover/divider, said one or more tabs each having an opening formed therethrough and being configured to receive at least part of a binding device therethrough to thereby couple said cover/divider to said binding device.

9. A bound system comprising:

a plurality of pages;

a front cover/divider a back cover/divider, at least one of said cover/dividers including a bound outer edge and a plurality of free outer edges, wherein said at least one cover/divider is bound to said plurality of pages along said bound edge, wherein said at least one cover/divider is configured to have one or more discrete tabs integrally formed within the cover/divider at a position spaced away from the associated outer cover/divider edge and initially defined by semi-weakened boundary which includes a tab fold line, said one or more discrete tabs deployable by folding along said tab fold line to a configuration extending generally outward relative to one of said free edges, each tab being integrally formed from a single piece of material with the rest of said at least one cover/divider, each tab further having an opening formed therethrough each opening being configured to receive at least part of a binding device therethrough to thereby couple said at least one cover/divider to said binding device; and a wire coil binding mechanism binding said plurality of pages to said at least one cover/divider along said bound edge, wherein said binding mechanism extends generally an entire length of said bound edge.

10. The system of claim 9 wherein said tabs are positioned on an opposite side of said at least one cover/divider relative to said binding mechanism.

11. The system of claim 9 further comprising a binding device having a plurality of rings, wherein one or more rings are received through an associated one of said tabs to couple said at least one cover/divider to said binding device.

12. The system of claim 9 wherein said at least one cover/divider is substantially continuous adjacent to each tab and lacks any openings adjacent to each tab.

13. The system of claim 9 wherein said at least one tab is seamlessly connected to a main body of said at least one cover/divider such that said at least one cover/divider lacks any hinge line positioned between said at least one tab and said main body of said at least one cover/divider.

14. The system of claim 9 wherein said at least one cover/divider includes a plurality of discrete spaced tabs positioned on said one of said free edges, wherein said at least one cover/divider lacks any structure positioned between each tab in a direction generally parallel to the associated free edge, other than the structure of the cover/divider.

15. The system of claim 9 wherein said at least one cover/divider is shaped and sized to generally cover an outer one of said plurality of pages when said at least one cover/divider is in a closed position, and wherein the other one of said cover/dividers is shaped and sized to cover another outer one of said plurality of pages when said other cover/divider is in a closed position, and wherein said other cover/divider is spaced apart from and not directly coupled to said at least one cover/divider.

16. A bound system comprising:

a plurality of pages; and a cover/divider including a bound outer edge and a plurality of free outer edges, wherein said cover/divider is bound to said plurality of pages along said bound edge by a binding mechanism selected from the group consisting of a twin wire coil, a spiral wire coil, a sewn binding, a bookstyle binding, and a plastic clip, wherein said cover/divider is configured to have one or more discrete tabs integrally formed within the cover/divider at a position spaced away from the associated outer cover/divider edge and initially defined by semi-weakened boundary which includes a tab fold line, said one or more discrete tabs deployable by folding along said tab fold line to a configuration extending generally outward relative to one of said free edges, each tab being integrally formed from a single piece of material with the rest of said cover/divider, each tab further having an opening formed therethrough and being configured to receive at least part of a binding device therethrough to thereby couple said cover/divider to said binding device.

17. The system of claim 16 further comprising a binding device having a plurality of rings, wherein one or more rings are received through an associated one of said tabs to couple said cover/divider to said binding device.

18. The system of claim 16 wherein said cover/divider is substantially continuous adjacent to each tab and lacks any openings adjacent to each tab.

19. The system of claim 16 wherein said at least one tab is seamlessly connected to a main body of said cover/divider such that said cover/divider lacks any hinge line positioned between said at least one tab and said main body of said cover/divider.

20. The system of claim 16 wherein said cover/divider includes a plurality of discrete spaced tabs positioned on said one of said free edges, wherein said cover/divider lacks any structure positioned between each tab in a direction generally parallel to the associated free edge, other than the structure of the cover/divider.

21. The system of claim 16 wherein said cover/divider is shaped and sized to generally cover an outer one of said plurality of pages when said cover/divider is in a closed position, and wherein the system further includes a supplemental cover/divider shaped and sized to cover another outer one of said plurality of pages when said supplemental cover/divider is in a closed position, and wherein said supplemental cover/divider is spaced apart from and not directly coupled to said cover/divider.

22. A divider comprising:

a bound outer edge and a plurality of free outer edges, one or more discrete tabs integrally formed from the cover/divider at a position spaced away from the associated outer cover/divider edge and initially defined by semi-weakened boundary which includes a tab fold line, said one or more discrete tabs deployable by folding along said tab fold line to a configuration extending generally outwardly relative to one of said free edges, each tab being integrally formed from a single piece of material with the rest of said divider, each tab further having an opening formed therethrough and being configured to receive at least part of a binding device therethrough to thereby couple said divider to said binding device, and a wire coil binding mechanism attached to said divider along said bound edge, and wherein said tabs are positioned on an opposite side of said divider relative to said binding mechanism.

23. The divider of claim 22, wherein said binding mechanism extends generally an entire length of said bound edge.

24. A system comprising:

a front cover/divider; and a back cover/divider coupled to said front cover/divider, wherein said at least one cover/divider is configured to have one or more discrete tabs integrally formed from within the cover/divider at a position spaced away from the associated outer cover/divider edge and initially defined by semi-weakened boundary which includes a tab fold line, said one or more discrete tabs deployable by folding along said tab fold line to a configuration extending the tab generally outward relative to one of said free edges, each tab being integrally formed from a single piece of material with the rest of said at least one cover/divider, each tab further having an opening formed therethrough each opening being configured to receive at least part of a binding device therethrough to thereby couple said at least one cover/divider to said binding device; and a wire coil binding mechanism binding said plurality of pages to said at least one cover/divider along said bound edge, and wherein said tabs are positioned on an opposite side of said at least one cover/divider relative to said binding mechanism.

* * * * *